US009525238B1

(12) United States Patent
Luksic

(10) Patent No.: US 9,525,238 B1
(45) Date of Patent: Dec. 20, 2016

(54) LOW PROFILE ELECTRICAL CONNECTOR

(71) Applicant: TYCO ELECTRONICS CORPORATION, Berwyn, PA (US)

(72) Inventor: Marek Tadeusz Luksic, Dillsburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/994,532

(22) Filed: Jan. 13, 2016

(51) Int. Cl.
*H01R 13/627* (2006.01)

(52) U.S. Cl.
CPC ..... *H01R 13/6273* (2013.01)

(58) Field of Classification Search
CPC .. H01R 13/6272; H01R 13/635; H01R 13/633
USPC ..... 439/352, 159, 923, 188, 489
See application file for complete search history.

(56) References Cited

U.S. PATENT DOCUMENTS 6,475,014 B2 * 11/2002 Tsuji ..... H01R 13/641 439/352
6,488,524 B2 * 12/2002 Endo ..... H01R 13/6272 439/353
6,595,793 B2 * 7/2003 Tsuji ..... H01R 13/641 439/352

* cited by examiner

*Primary Examiner* — Phuongchi T Nguyen

(57) ABSTRACT

A low profile electrical connector includes a connector body having a top, a bottom and opposite sides. The connector body has a width defining a width profile and a height defining a height profile of the connector body. The electrical connector includes a latch extending from the connector body. The latch has a first latch, a second latch and an actuator operably connected to the latches. The first and second latches are positioned along the first and second sides. The actuator extends along the top and is actuated downward to deflect the first and second latches from latching positions to released positions. The first and second latches are positioned below the top and above the bottom such that the first and second latches are entirely contained within the height profile of the connector body.

15 Claims, 2 Drawing Sheets

LOW PROFILE ELECTRICAL CONNECTOR

BACKGROUND OF THE INVENTION

The subject matter herein relates generally to low profile electrical connectors.

Electrical connectors are typically mated and secured together using latches. For some applications, the preferred action to release the mated connectors is to apply a releasing action to the retaining latches on the top (or bottom) surface of the connector body. For example, the top (or bottom) may be more readily accessible. The top (or bottom) may be larger and easier for the handler to manipulate. Conventional electrical connectors employing the top (or bottom) release action having latching features that protrude above the surface (top or bottom) of the connector body and increase the profile size envelope of the connector.

A need remains for an electrical connector having a low profile height having conveniently releasable latches.

BRIEF DESCRIPTION OF THE INVENTION

In one embodiment, a low profile electrical connector is provided including a connector body having a mating end, configured to be mated with a mating connector, and a back end opposite the mating end. Contact channels extend between the mating end and the back end holding contacts therein with wires extending from the back end. The connector body has a top, a bottom and opposite first and second sides extending between the top and the bottom. The connector body has a width measured between the first and second sides defining a width profile and a height measured between the top and the bottom defining a height profile of the connector body. The height is shorter than the width. The electrical connector includes a latch extending from the connector body. The latch has a first latch, a second latch and an actuator operably connected to the first and second latches. The first latch is positioned along the first side. The second latch is positioned along the second side. The actuator extends along the top and is actuated to deflect the first and second latches from latching positions to released positions. The first and second latches are positioned below the top and above the bottom such that the first and second latches are entirely contained within the height profile of the connector body.

In another embodiment, a low profile electrical connector is provided including a connector body having a mating end configured to be mated with a mating connector and a back end opposite the mating end. Contact channels extend between the mating end and the back end holding contacts therein with wires extending from the back end. The connector body has a top, a bottom and opposite first and second sides extending between the top and the bottom. The connector body has a width measured between the first and second sides defining a width profile and a height measured between the top and the bottom defining a height profile of the connector body. The height is shorter than the width. The electrical connector includes a latch along the first side. The latch has a latch arm and a latching member at a distal end of the latch arm configured to engage a corresponding mating latch of the mating connector. The latch is positioned below the top and above the bottom such that the latch is entirely contained within the height profile of the connector body.

In a further embodiment, a low profile electrical connector system is provided including an electrical connector comprising a connector body having a mating end and a back end opposite the mating end with contact channels extending between the mating end and the back end holding contacts therein with wires extending from the back end. The connector body has a top, a bottom and opposite first and second sides extending between the top and the bottom. The connector body has a width measured between the first and second sides defining a width profile and a height measured between the top and the bottom defining a height profile of the connector body. The height is shorter than the width. The electrical connector includes a latch extending from the connector body. The latch has a first latch, a second latch and an actuator operably connected to the first and second latches. The first latch is positioned along the first side and the second latch being positioned along the second side. The actuator extends along the top and is actuated to deflect the first and second latches from latching positions to released positions. The first and second latches are positioned below the top and above the bottom such that the first and second latches are entirely contained within the height profile of the connector body. The electrical connector system includes a mating connector with a mating connector body having a mating end and a back end opposite the mating end with contact channels extending between the mating end and the back end holding mating contacts therein with wires extending from the back end. The mating end is mated to the mating end of the electrical connector. The mating connector body has a top, a bottom and opposite first and second sides extending between the top and the bottom. The mating connector body has a width measured between the first and second sides defining a width profile and a height measured between the top and the bottom defining a height profile of the mating connector body. The height is shorter than the width. The mating connector includes rigid latches extending from the first and second sides of the mating connector body for latching engagement with the first and second latches of the electrical connector. The first and second rigid latches are positioned below the top and above the bottom of the mating connector body such that the first and second rigid latches are entirely contained within the height profile of the mating connector body.

DETAILED DESCRIPTION OF THE INVENTION

Figure 1:
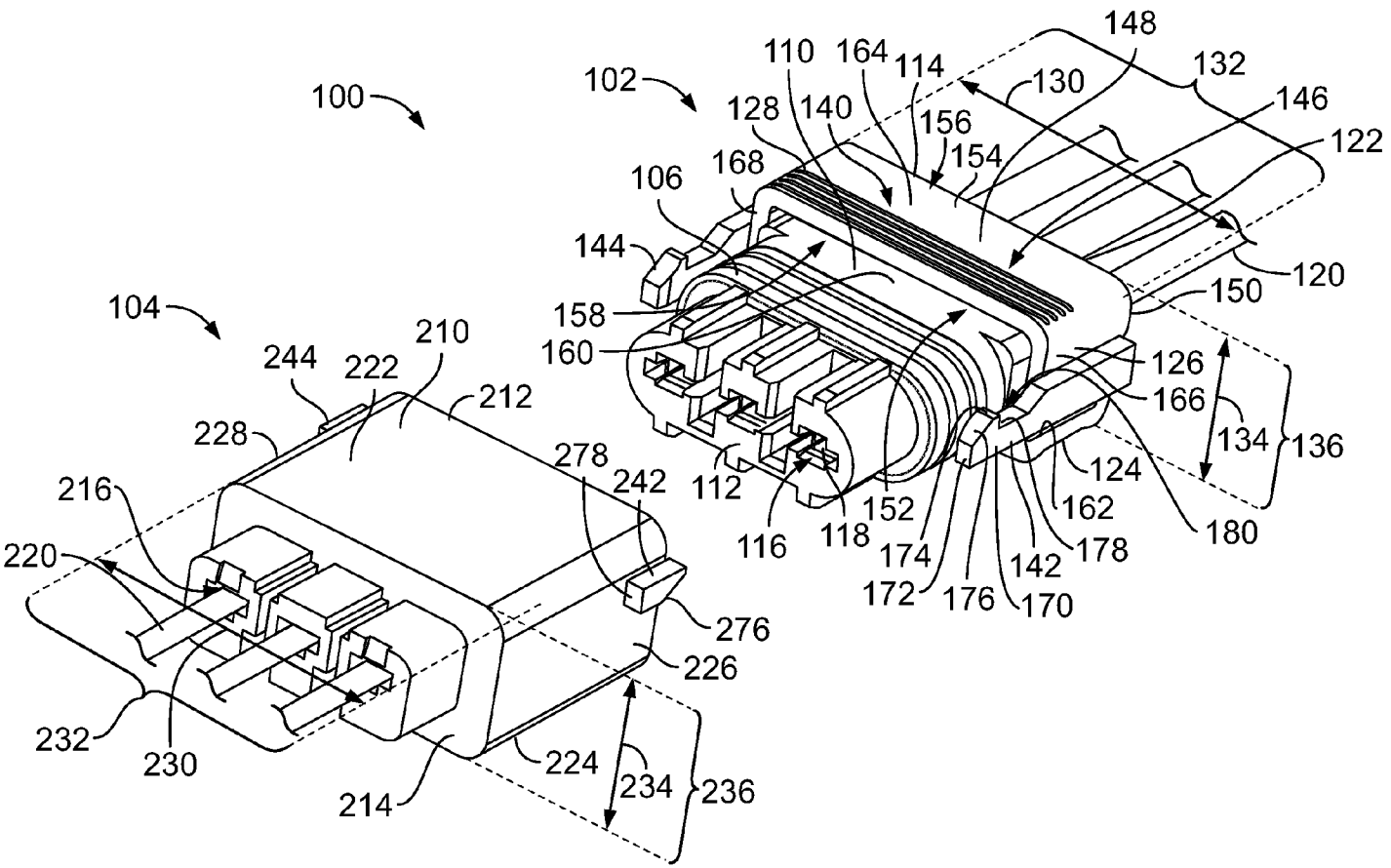
FIG. 1 is a perspective view of an electrical connector system formed in accordance with an exemplary embodiment.

FIG. 1 is a perspective view of an electrical connector system 100 formed in accordance with an exemplary embodiment. The electrical connector system 100 includes a first electrical connector 102 and a second electrical connector 104 configured to be mated with the first electrical connector 102. The second electrical connector 104 defines a mating connector 104 for the electrical connector 102 (and the first electrical connector 102 defines a mating connector 102 for the electrical connector 104). Optionally, at least a portion of the first electrical connector 102 is configured to be received in the second electrical connector 104. Various components, while illustrated and described as being on the first electrical connector 102 or the second electrical connector 104, may be provided on the other connector in alternative embodiments (for example, the second electrical connector may include embodiments of the latch described herein). The first electrical connector 102 includes a seal 106 for sealed mating with the second electrical connector 104. The electrical connectors 102, 104 may be unsealed in alternative embodiments. Optionally, the electrical connectors 102, 104 may be any type of electrical connectors. In an exemplary embodiment, the electrical connectors 102, 104 may be used in an automotive application; however, the electrical connectors 102, 104 may be used in other applications in alternative embodiments.

In an exemplary embodiment, the electrical connectors 102, 104 are low profile electrical connectors. The electrical connectors 102, 104 have a low profile height, which may allow use of the electrical connectors 102, 104 in applications having certain size constraints. In an exemplary embodiment, the electrical connectors 102, 104 provide the latching arrangement along the sides as opposed to along the top or bottom, which maintains the low profile for the electrical connectors 102, 104. By eliminating latches along the top or the bottom, the resulting profile height is decreased as compared to conventional connectors that have latches on the top or bottom surfaces. In an exemplary embodiment, actuation of the latch may be accomplished from above the electrical connector 102.

The first electrical connector 102 includes a connector body 110 having a mating end 112 configured to be mated to the second electrical connector 104. The mating end 112 may be plugged into the second electrical connector 104. The dimensions of the mating end 112 may be smaller than other dimensions of the connector body 110 to allow the mating end 112 to be plugged into the second electrical connector 104. The first electrical connector 102 has a back end 114 opposite the mating end 112.

The connector body 110 includes contact channels 116 extending between the mating end 112 and the back end 114. The contact channels 116 hold contacts 118 therein. Wires 120 terminated to the contacts 118 extend from the back end 114. The wires 120 may be terminated to the contacts 118 by any means or processes, such as crimping, soldering, insulation displacement or other processes. In other alternative embodiments, rather than being terminated to wires 120, the contacts 118 may be terminated to a circuit board or other electrical component.

The connector body 110 has a top 122, a bottom 124, and opposite first and second sides 126, 128. The sides 126, 128 extend between the top 122 and the bottom 124. The connector body 110 has a width 130 measured between the first and second sides 126, 128 defining a width envelope or width profile 132 extending forward and/or rearward the connector body 110. The connector body 110 has a height 134 measured between the top 122 and the bottom 124 defining a height envelope or height profile 136 extending forward and/or rearward the connector body 110. The envelope/profile is the maximum size of the connector body 110 in the given dimension (for example, maximum width or maximum height). In an exemplary embodiment, the first electrical connector 102 is short and wide such that the height 134 is shorter than the width 130. The height profile 136 is lower profile than the width profile 132.

The first electrical connector 102 includes a latch 140 extending from the connector body 110. The latch 140 has a first latch 142, a second latch 144 and an actuator 146 operably connected to the first and second latches 142, 144. The first latch 142 is positioned along the first side 126. The second latch 144 is positioned along the second side 128. In an exemplary embodiment, the first and second latches 142, 144 are generally in line with or coplanar with the row of contacts 118. The actuator 146 extends along the top 122. The actuator 146 is actuated downward to deflect the first and second latches 142, 144 from latched positions to released positions.

In an exemplary embodiment, the latch 140 is contained within the height profile 136. For example, the first and second latches 142, 144 are positioned below the top 122 and above the bottom 124 such that the first and second latches 142, 144 are entirely contained within the height profile 136 of the connector body 110. The first and second latches 142, 144 thus do not add to the overall height dimension of the connector body 110. In an exemplary embodiment, the actuator 146 includes an outer surface 148. The outer surface 148 may be generally flush with the top 122 of the connector body 110 such that the actuator 146 is entirely contained within the height profile 136 of the connector body. Alternatively, the actuator 146 may be recessed below the top 122. The actuator 146 does not add to the overall height dimension of the connector body 110.

In an exemplary embodiment, the actuator 146 is accessible from above the connector body 110 and is actuated by pressing downward on the outer surface 148 to actuate the actuator 146 causing the latches 142, 144 to be deflected from the latched positions to the released positions. In an exemplary embodiment, the actuator 146 rotates (for example, pivots) the latches 142, 144 between the latched positions and the released positions.

In an exemplary embodiment, the connector body 110 includes a back wall 150 at or near the back end 114. The actuator 146 is positioned forward of the back wall 150. The connector body 110 includes a pocket 152 forward of the back wall 150. The actuator 146 is positioned in the pocket 152 such that the actuator 146 may be flush with the outer perimeter of the connector body 110 and/or recessed inward with respect to the outer perimeter of the connector body 110. In an exemplary embodiment, the actuator 146 is attached to an actuator mount 154 of the back wall 150. For example, an elastic hinge 156 is provided between the actuator mount 154 and the actuator 146. The actuator 146 may be pivoted about the hinge 156 to release the latches 142, 144.

In an exemplary embodiment, the latch 140 is co-molded with the connector body 110 such that the latch 140 and the connector body 110 are integral with each other. The latch 140 and connector body 110 may be co-molded in a single-shot molding process to reduce assembly time and number of components for the electrical connector 102. Alternatively, the latch 140 may be separate from the connector body 110 and attached thereto, such as about pivot members, such as pivot pins.

In an exemplary embodiment, a gap 158 is formed between the actuator 146 and a pocket wall 160 of the connector body 110 defining a portion of the pocket 152. The gap 158 provides a space with a calibrated height for the actuator 146 to be pressed downward to release the latches 142, 144. The pocket wall 160 may limit deflection of the actuator 146 and define a stop surface for pivoting of the latch 140. Additionally or alternatively, the connector body 110 may include a shoulder 162 positioned below the latches 142, 144. The shoulder 162 may limit deflection of the latch 140 and define a stop surface for pivoting of the latch 140.

In an exemplary embodiment, the actuator 146 includes a lever 164 extending across the top 122 and tabs 166, 168 extending downward from opposite sides of the lever 164. The latches 142, 144 may extend forward from the tabs 166, 168, respectively. The lever 164 is accessible at the top 122 of the connector body 110 to allow actuation of the latch 140. The tabs 166, 168 may extend along the sides 126, 128. Optionally, the tabs 166, 168 may be at least partially recessed into the pocket 152 or otherwise recessed into the connector body 110 such that the tabs 166, 168 do not adversely affect the width profile 132. The latches 142, 144 may have a thickness that extends outward beyond the outer surfaces of the tabs 166, 168 such that the latches 142, 144 extend beyond the tabs 166, 168 and increase the width profile of the connector body 110 by the thicknesses of the latches. Having the latches 142, 144 extend outward from the tabs 166, 168 allows the latches 142, 144 to extend along the sides of the mating connector for mating with the mating latches.

The latches 142, 144 may be similar to each other and may include similar features. The first latch 142 is described in detail below; however, the second latch 144 may include similar or identical features. The latch 142 includes an arm 170 extending forward from the tab 166. The arm 170 extends to a distal end 172. The latch 142 includes a latching member 174 at the distal end 172 that is configured for latching engagement with the mating connector 104. In an exemplary embodiment, the latching member 174 includes a ramp 176 at the front end thereof configured to allow automatic deflection of the latch 142 during mating with the mating connector 104. The latching member 174 includes a catch 178 behind the ramp 176. Optionally, the catch 178 may be a substantially vertical surface configured to engage the mating latch of the mating connector 104 for latching engagement with the mating latch of the mating connector 104. A pocket 180 is provided in the arm 170 rearward of the catch 178 that receives the mating latch of the mating connector 104. The latch 142 may have other shapes or features in alternative embodiments. The arm 170 is deflectable to allow latching engagement with the mating latch of the mating connector 104.

The second electrical connector 104 includes a connector body 210 having a mating end 212 configured to be mated to the first electrical connector 102. The mating end 212 includes a receptacle configured to receive the first electrical connector 102. The second electrical connector 104 has a back end 214 opposite the mating end 212.

The connector body 210 includes contact channels 216 extending between the mating end 212 and the back end 214. The contact channels 216 hold contacts (not shown) therein. Wires 220 terminated to the contacts extend from the back end 214. The wires 220 may be terminated to the contacts by any means or processes, such as crimping, soldering, insulation displacement or other processes. In other alternative embodiments, rather than being terminated to wires 220, the contacts may be terminated to a circuit board or other electrical component.

The connector body 210 has a top 222, a bottom 224, and opposite first and second sides 226, 228. The sides 226, 228 extend between the top 222 and the bottom 224. The connector body 210 has a width 230 measured between the first and second sides 226, 228 defining a width envelope or width profile 232 extending forward and/or rearward the connector body 210. The connector body 210 has a height 234 measured between the top 222 and the bottom 224 defining a height envelope or height profile 236 extending forward and/or rearward the connector body 210. In an exemplary embodiment, the second electrical connector 104 is short and wide such that the height 234 is shorter than the width 230. The height profile 236 is lower profile than the width profile 232.

The second electrical connector 104 includes rigid latches 242, 244 having a fixed position and extending from the sides 226, 228 of the connector body 210. In an exemplary embodiment, the latches 242, 244 are contained within the height profile 236. For example, the first and second rigid latches 242, 244 are positioned below the top 222 and above the bottom 224 such that the first and second rigid latches 242, 244 are entirely contained within the height profile 236 of the connector body 210. The first and second rigid latches 242, 244 thus do not add to the overall height dimension of the connector body 210.

The rigid latches 242, 244 may be similar to each other and may include similar features. The first rigid latch 242 is described in detail below; however, the second rigid latch 244 may include similar or identical features. The rigid latch 242 includes a ramp 276 at the front end thereof configured to allow automatic deflection of the latch 142 as the first electrical connector 102 is mated to the second electrical connector 104. The rigid latch 242 includes a catch 278 behind the ramp 276 defining a surface configured to engage the latching member 174 for latching engagement with the latch 142. The rigid latch 242 may have other shapes or features in alternative embodiments.

Figure 2:
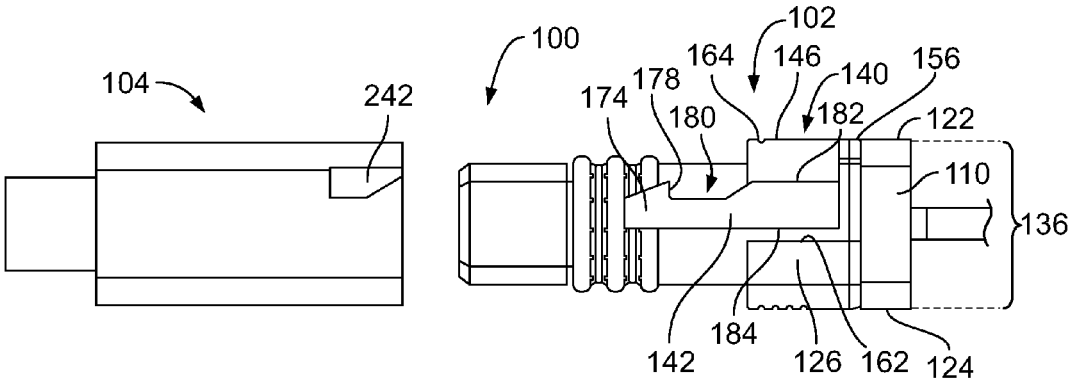
FIG. 2 is a side view of the electrical connector system showing a first electrical connector poised for mating with a second electrical connector.
Figure 3:
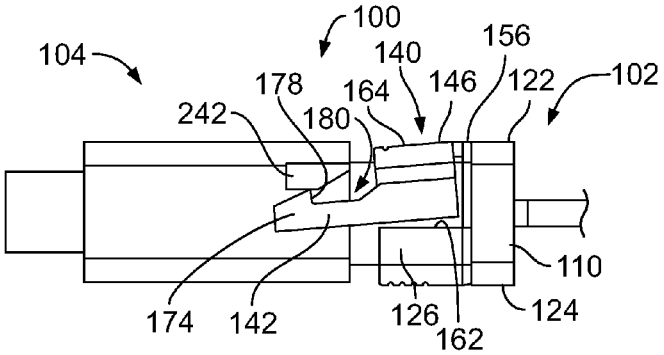
FIG. 3 is a side view of the electrical connector system showing the first electrical connector in a partially mated or a partially un-mated state.
Figure 4:
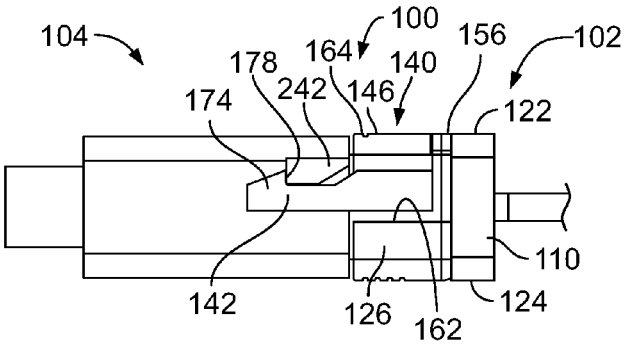
FIG. 4 is a side view of the electrical connector system showing the first electrical connector in a fully mated state.

FIG. 2 is a side view of the electrical connector system 100 showing the first electrical connector 102 poised for mating with the second electrical connector 104. FIG. 3 is a side view of the electrical connector system 100 showing the first electrical connector 102 in a partially mated or a partially un-mated state. FIG. 4 is a side view of the electrical connector system 100 showing the first electrical connector 102 in a fully mated state. As can be seen in FIGS. 2-4, the latch 140 is entirely contained within the height profile 136 of the connector body 110. An upper surface 182 of the latch 142 is positioned below the top 122 of the connector body 110. A lower surface 184 of the latch 142 opposite the upper surface 182 is positioned above the bottom 124 of the connector body 110. As such, the latch 142 is entirely contained within the height profile 136 of the connector body 110.

During mating and un-mating, the latch 140 is deflected to the released position to allow the latching member 174 to clear the rigid latch 242. The latch 140 is pivoted about the hinge 156 such that the latching member 174 passes below the rigid latch 242. When fully mated, the latch 140 is in the latched position (FIG. 5) with the catch 178 positioned behind the rigid latch 242. The rigid latch 242 is received in the pocket 180 and the latching member 174 is latchably secured to the rigid latch 242. To unlatch the first electrical connector 102 from the second electrical connector 104, the operator presses downward on the lever 164 of the actuator 146 to pivot the latch 142 downward to clear the rigid latch 242. The shoulder 162 may stop or limit pivoting of the latch 140 so that the hinge 156 is not overstressed. Alternatively, the calibrated height of the gap 158 may stop or limit pivoting of the latch 140.

Providing the latch 142 on the side 126 of the connector body 110, as opposed to along the top 122 or the bottom 124 reduces the overall height profile 136 of the electrical connector 102. However, the latch release action remains applied to the top 122, which may be more accessible and is a larger surface area for actuation by the operator. Additionally, both latches 142, 144 may be simultaneously actuated by pressing downward on the lever 164. Additionally, providing two latches 142, 144 provides redundant latching for the electrical connector 102 ensuring that the electrical connector 102 remains latched even if one of the latches 142, 144 were to fail, break, or improperly latch.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A low profile electrical connector comprising:

a connector body having a mating end configured to be mated with a mating connector and a back end opposite the mating end, contact channels extending between the mating end and the back end holding contacts therein with wires extending from the back end, the connector body having a top, a bottom and opposite first and second sides extending between the top and the bottom, the connector body having an actuator mount, the connector body having a width measured between the first and second sides defining a width profile and a height measured between the top and the bottom defining a height profile of the connector body, the height being shorter than the width;

a latch extending from the connector body, the latch having a first latch, a second latch and an actuator operably connected to the first and second latches, the first latch being positioned along the first side, the second latch being positioned along the second side, the actuator extending along the top and being actuated downward to deflect the first and second latches from latching positions to released positions, the actuator including a hinge between the actuator and the actuator mount of the connector body, the actuator being pivoted about the hinge to release the first and second latches, the latch having an upper surface and a lower surface opposite the upper surface, the upper surface being at or below the top, the lower surface being at or above the bottom, the first and second latches being positioned below the top and above the bottom such that the first and second latches are entirely contained within the height profile of the connector body.

2. The low profile electrical connector of claim 1, wherein the latch is rotatably coupled to the connector body.

3. The low profile electrical connector of claim 1, wherein the actuator has an upper surface generally flush with the top such that the actuator is entirely contained within the height profile of the connector body.

4. The low profile electrical connector of claim 1, wherein the connector body includes a pocket at the top defining a gap between the actuator and a pocket wall of the connector body, the actuator being positioned in the pocket, the actuator being moved toward the pocket wall to release a latching member from a mating latch of the mating connector.

5. The low profile electrical connector of claim 1, wherein the actuator and the first and second latches are co-molded with the connector body such that the actuator and the first and second latches are integral with the connector body and connected to the connecter body at a hinge.

6. A low profile electrical connector comprising:

a connector body having a mating end configured to be mated with a mating connector and a back end opposite the mating end, contact channels extending between the mating end and the back end holding contacts therein with wires extending from the back end, the connector body having a top, a bottom and opposite first and second sides extending between the top and the bottom, the connector body including a pocket at the top defined by a pocket wall, the connector body having a width measured between the first and second sides defining a width profile and a height measured between the top and the bottom defining a height profile of the connector body, the height being shorter than the width;

a latch along the first side, the latch having a latch arm and a latching member at a distal end of the latch arm configured to engage a corresponding mating latch of the mating connector, the latch including an actuator positioned in the pocket such that a gap is defined between the actuator and the pocket wall, the actuator being accessible at the top and actuated from above the connector body to move the actuator in the gap and release the latching member from the mating latch, the actuator having a top surface generally coplanar with the top such that the actuator is entirely contained within the height profile of the connector body, the latch being positioned below the top and above the bottom such that the latch is entirely contained within the height profile of the connector body.

7. The low profile electrical connector of claim 6, wherein the latch includes an upper surface and a lower surface opposite the upper surface, the upper surface being at or below the top, the lower surface being at or below the bottom.

8. The low profile electrical connector of claim 6, wherein the latch has a thickness, the latch increasing the width profile by the thickness.

9. The low profile electrical connector of claim 6, wherein the latch is rotatably coupled to the connector body.

10. The low profile electrical connector of claim 6, wherein the latch is co-molded with the connector body such that the latch is integral with the connector body.

11. The low profile electrical connector of claim 6, wherein the latch defines a first latch, the electrical connector further comprising a second latch along the second side and an actuator operably coupled to the first and second latches, the actuator extending along the top and being actuated downward to deflect the first and second latches from latched positions to released positions.

12. The low profile electrical connector of claim 11, wherein the second latch and the actuator are both entirely contained within the height profile of the connector body.

13. The low profile electrical connector of claim 11, wherein the actuator includes a hinge between the actuator and an actuator mount of the connector body, the actuator being pivoted about the hinge to release the first and second latches.

14. The low profile electrical connector of claim 11, wherein the actuator and the first and second flexible latches are co-molded with the connector body such that the actuator and the first and second latches are integral with the connector body and connected to the connecter body at a hinge.

15. A low profile electrical connector system comprising:

an electrical connector comprising a connector body having a mating end and a back end opposite the mating end with contact channels extending between the mating end and the back end holding contacts therein with wires extending from the back end, the connector body having a top, a bottom and opposite first and second sides extending between the top and the bottom, the connector body having a width measured between the first and second sides defining a width profile and a height measured between the top and the bottom defining a height profile of the connector body, the height being shorter than the width, the electrical connector comprising a latch extending from the connector body, the latch having a first latch, a second latch and an actuator operably connected to the first and second latches, the first latch being positioned along the first side, the second latch being positioned along the second side, the actuator extending along the top and being actuated downward to deflect the first and second latches from latching positions to released positions, the first and second latches being positioned below the top and above the bottom such that the first and second latches are entirely contained within the height profile of the connector body; and a mating connector comprising a mating connector body having a mating end and a back end opposite the mating end with contact channels extending between the mating end and the back end holding mating contacts therein with wires extending from the back end, the mating end being mated to the mating end of the electrical connector, the mating connector body having a top, a bottom and opposite first and second sides extending between the top and the bottom, the mating connector body having a width measured between the first and second sides defining a width profile and a height measured between the top and the bottom defining a height profile of the mating connector body, the height being shorter than the width, the mating connector comprising rigid latches extending from the first and second sides of the mating connector body for latching engagement with the first and second latches, the first and second rigid latches being positioned below the top and above the bottom of the mating connector body such that the first and second rigid latches are entirely contained within the height profile of the mating connector body.

* * * * *